United States Patent [19]

Wheeler et al.

[11] Patent Number: 4,552,630

[45] Date of Patent: Nov. 12, 1985

[54] CERAMIC OXIDE ELECTRODES FOR MOLTEN SALT ELECTROLYSIS

[75] Inventors: Douglas J. Wheeler, Cleveland Heights, Ohio; Jean-Jacques R. Duruz, Geneva, Switzerland; Ajit Y. Sane, Willoughby, Ohio; Jean-Pierre Derivaz, Geneva, Switzerland

[73] Assignee: ELTECH Systems Corporation, Boca Raton, Fla.

[21] Appl. No.: 298,243

[22] PCT Filed: Dec. 4, 1980

[86] PCT No.: PCT/US80/01609

§ 371 Date: Jul. 24, 1981

§ 102(e) Date: Jul. 24, 1981

[87] PCT Pub. No.: WO81/01717

PCT Pub. Date: Jun. 25, 1981

[30] Foreign Application Priority Data

Dec. 6, 1979 [GB] United Kingdom ..... 7942180

[51] Int. Cl.[4] ..... C25C 3/06; C25B 11/04

[52] U.S. Cl. ..... 204/67; 204/64 R; 204/243 R; 204/292; 264/65

[58] Field of Search ..... 204/67, 64 R, 291, 292, 204/293, 290 L, 243 R; 264/65

[56] References Cited

U.S. PATENT DOCUMENTS

| | | | |
|---|---|---|---|
| 3,528,857 | 9/1970 | Leib et al. | 204/290 R |
| 3,718,550 | 2/1973 | Klein | 204/291 |
| 3,804,740 | 4/1974 | Welch | 204/290 R |
| 3,930,967 | 1/1976 | Alder | 204/67 |
| 3,960,678 | 6/1976 | Alder | 204/290 R |
| 3,962,068 | 6/1976 | Zöllner et al. | 204/290 R |
| 3,977,958 | 8/1976 | Caldwell et al. | 204/290 R |
| 4,012,296 | 3/1977 | Stephens et al. | 204/291 |
| 4,039,401 | 8/1977 | Yamada et al. | 204/67 |
| 4,132,619 | 1/1979 | Klein et al. | 204/291 |
| 4,173,518 | 11/1979 | Yamada et al. | 204/290 R |
| 4,187,155 | 2/1980 | de Nora et al. | 204/67 |
| 4,357,226 | 11/1982 | Alder | 204/67 |
| 4,399,008 | 8/1983 | Ray | 204/67 |

*Primary Examiner*—Andrew H. Metz
*Assistant Examiner*—Terryence Chapman
*Attorney, Agent, or Firm*—Arthur S. Collins

[57] ABSTRACT

A substantially non-consumable anode used in the production of aluminium from a cryolite-based fused bath containing alumina consists of a sintered self-sustaining ceramic oxide body of spinel structure which is made conductive by selective partial substitution, the introduction of non-stoichiometry or by doping so as to maintain the impurities in the produced aluminium at low levels. Preferred materials are partially-substituted nickel ferrite spinels.

26 Claims, 1 Drawing Figure

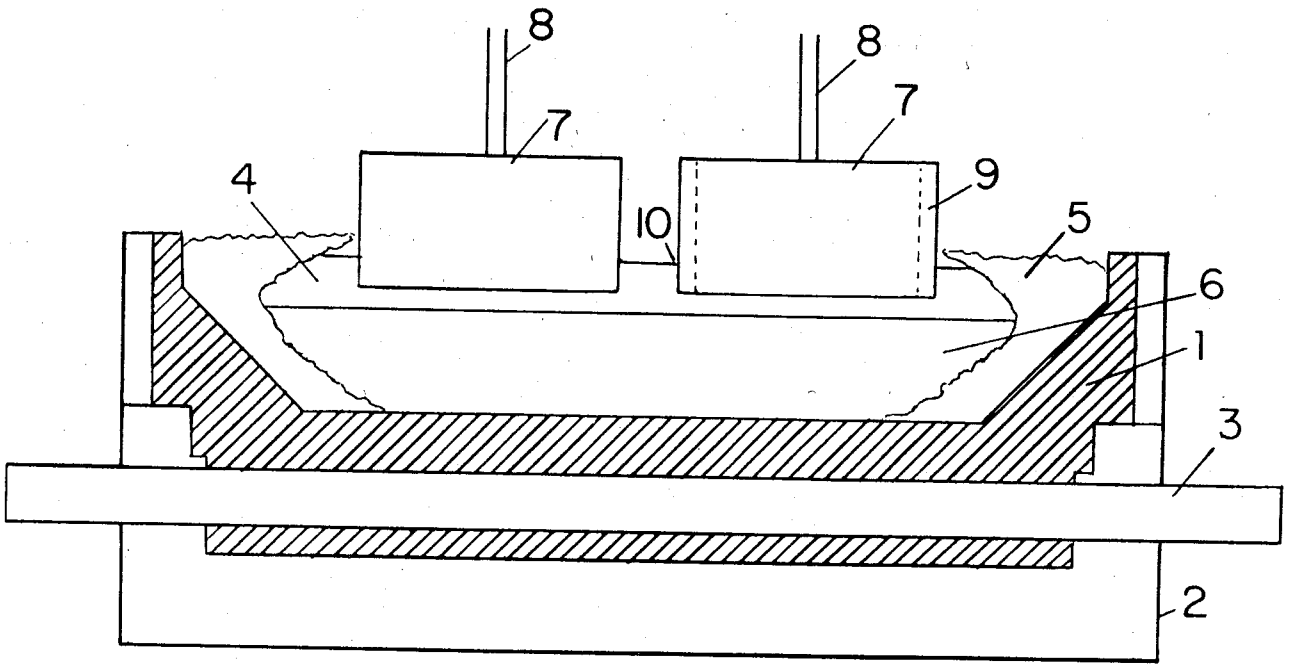
8
7
9
5
6
1
3
2
8
7
10
4

CERAMIC OXIDE ELECTRODES FOR MOLTEN SALT ELECTROLYSIS

TECHNICAL FIELD

The invention relates to the electrolysis of molten salts particularly in an oxygen-evolving melt, such as the production of aluminium from a cryolite-based fused bath containing alumina, and to anodes for this purpose comprising a body of ceramic oxide material which dips into the molten salt bath, as well as to aluminium production cells incorporating such anodes.

BACKGROUND ART

The conventional Hall-Heroult process for aluminium production uses carbon anodes which are consumed by oxidation. The replacement of these consumable carbon anodes by substantially non-consumable anodes of ceramic oxide materials was suggested many years ago by Belyaev who investigated various sintered oxide materials including ferrites and demonstrated the feasibility of using these materials (Chem. Abstract 31 (1937) 8384 and 32 (1938) 6553). However, Belyaev's results with sintered ferrites, such as $SnO_2.Fe_2O_3$, $NiO.Fe_2O_3$ and $ZnO.Fe_2O_3$, show that the cathodic aluminium is contaminated with 4000–5000 ppm of tin, nickel or zinc and 12000–16000 ppm of iron, which rules out these materials for commercial use.

Considerable efforts have since been made to design expedients which offset the defects of the anode materials (see for example U.S. Pat. Nos. 3,974,046 and 4,057,480) and to develop new anode materials which stand up better to the operating conditions. Some of the main requirements of the ideal non-consumable anode material for aluminium production are: thermal stability and good electrical conductivity at the operating temperature (about 940° C. to 1000° C.); resistance to oxidation; little solubility in the melt; and non-contamination of the aluminium product with undesired impurities.

U.S. Pat. No. 4,039,401 discloses various stoichiometric sintered spinel oxides (excluding ferrites of the formula $Me^{2+}Fe_2^{3+}O_4$) but recognized that the spinels disclosed had poor conductivity, necessitating mixture thereof with various conductive perovskites or with other conductive agents in an amount of up to 50% of the material.

West German published patent application (Offenlegungsschrift) DE-OS No. 23 20 883 describes improvements over the known magnetite electrodes for aqueous electrolysis by providing a sintered material of the formula $$M_xFe_{3-x}O_4$$

which can be rewritten $$M_x^{2+}Fe_{1-x}^{2+}Fe_2^{3+}O_4,$$

where M represents Mn, Ni, Co, Mg, Cu, Zn and/or Cd and x is from 0.05 to 0.4. The data given show that when x is above 0.4 the conductivity of these materials drops dramatically and their use was therefore disconsidered.

DISCLOSURE OF THE INVENTION

The invention, as set out in the claims, provides an anode material resistant to the conditions encountered in molten salt electrolysis and in particular in aluminium production, having a body consisting essentially of a ceramic oxide spinel material of the formula $$M_{Ix}M_{II3-x}O_4 \cdot y\,M_{III}^{n+}O_{n/2}$$

where:

$M_I$ is one or more divalent metals from the group Ni, Co, Mg, Mn, Cu and Zn;

x is 0.5–1.0 (preferably, 0.8–0.99);

$M_{II}$ is one or more divalent/trivalent metals from the group Ni, Co, Mn and Fe, but excluding the case where $M_I$ and $M_{II}$ are both the same single metal (preferably, $M_{II}$ is Fe or is predominantly Fe with up to 0.2 atoms of Ni, Co or Mn);

$M_{III}^{n+}$ is one or more metals from the group $Ti^{4+}$, $Zr^{4+}$, $Sn^{4+}$, $Fe^{4+}$, $Hf^{4+}$ $Mn^{4+}$, $Fe^{3+}$, $Ni^{3+}$, $Co^{3+}$, $Mn^{3+}$, $Al^{3+}$ and $Cr^{3+}$, $Fe^{2+}$, $Ni^{2+}$, $Co^{2+}$, $Mg^{2+}$, $Mn^{2+}$, $Cu^{2+}$ and $Zn^{2+}$, and $Li^{1+}$, where n is 1, 2, 3 or 4 depending upon the valence state of $M_{III}$; and the value of y is compatible with the solubility of $$M_{III}^{n+}O_{n/2}$$

in the spinel lattice, providing that $y \neq 0$ when (a) $x=1$, (b) there is only one metal $M_I$, and (c) there is only one metal $M_{II}$ or there are two metals $M_{II}$ in an equal whole atom ratio.

Ceramic oxide spinels of this formula, in particular the ferrite spinels, have been found to provide an excellent compromise of properties making them useful as substantially non-consumable anodes in aluminium production from a cryolite-alumina melt. There is no substantial dissolution in the melt so that the metals detected in the aluminium produced remain at sufficiently low levels to be tolerated in commercial production.

In the preferred case where $M_{II}$ is $Fe^{3+}/Fe^{2+}$, the formula covers ferrite spinels and can be written $$M_{Ix}^{2+}Fe_{1-x}^{2+}Fe_2^{3+}O_4.yM_{III}^{n+}O_{n/2}$$

The basic stoichiometric ferrite materials such as $NiFe_2O_4$, $ZnFe_2O_4$ and $CoFe_2O_4$ (i.e., when $x=1$ and $y=0$) are poor conductors, i.e., their specific electronic conductivity at 1000° C. is of the order of 0.01 $ohm^{-1}cm^{-1}$. When x has a value below 0.5, the conductivity is improved to the order of 20 or more $ohm^{-1}cm^{-1}$ at 1000° C., but this is accompanied by an increase in the relatively more oxidizable $Fe^{2+}$, which is more soluble in cryolite and leads to an unacceptably high dissolution rate in the molten salt bath and contamination of the aluminium or other metal produced with too much iron. However, for partially substituted ferrites when $x=0.5$–$0.99$ and preferably 0.8–0.99 (i.e., even when $y=0$), the properties of the basic ferrite materials as aluminium electrowinning anodes are enhanced by an improved conductivity and a low corrosion rate, the contamination of the electrowon aluminium by iron remaining at an acceptable level, near or below 1500 ppm. Particularly satisfactory partially-substituted ferrites are the nickel ones such as $Ni_{0.9}^{2+}Fe_{0.1}^{2+}Fe_2^{3+}O_4$ and $Mn_{0.5}Zn_{0.25}Fe_{0.25}Fe_2O_4$.

The most chemically inert of the ferrites, i.e., the fully substituted ferrites which do not contain $Fe^{2+}(x=1)$, can also be rendered sufficiently conductive to operate well as aluminium electrowinning electrodes by doping them or introducing non-stoichiometry by incorporation into the spinel lattice of suitable small quantities of the oxides $$M_{III}^{n+}O_{n/2}.$$

In this context, "doping" will be used to describe the case where the additional metal cation $M_{III}^{n+}$ is different from $M_I$ and $M_{II}$, and "non-stoichiometry" will be used to describe the case where $M_{III}$ is the same as $M_I$ and/or $M_{II}$. Combinations of doping and non-stoichiometry are of course possible when two or more cations $M_{III}$ are introduced.

In the case of doping (i.e., $M_{III} \neq M_I$ or $Fe^{3+}$ in the case of the ferrites), when $M_I^{2+}$ is Ni and/or Zn, any of the listed dopants $M_{III}$ gives the desired effect. Apparently, $Ti^{4+}$, $Zr^{4+}$, $Hf^{4+}$, $Sn^{4+}$ and $Fe^{4+}$ are incorporated by solid solution into sites of $Fe^{3+}$ in the spinel lattice, thereby increasing the conductivity of the material at about 1000° C. by inducing neighbouring $Fe^{3+}$ ions in the lattice into an $Fe^{2+}$ valency state, without these ions in the $Fe^{2+}$ state becoming soluble. $Cr^{3+}$ and $Al^{3+}$ are believed to act by solid solution substitution in the lattice sites of the $M_I^{2+}$ ions (i.e., Ni and/or Zn), and induction of $Fe^{3+}$ ions to the $Fe^{2+}$ state. Finally, the $Li^{+}$ ions are also believed to occupy sites of the $M_I^{2+}$ ions (Ni and/or Zn) by solid-solution subsititution, but their action induces the $M_I^{2+}$ ions to the trivalent state. When $M_I^{2+}$ is Mg and/or Cu, the dopant $M_{III}$ is preferably chosen from $Ti^{4+}$, $Zr^{4+}$ and $Hf^{4+}$ and when $M_I^{2+}$ is Co, the dopant is preferably chosen from $Ti^{4+}$, $Zr^{4+}$, $Hf^{4+}$ and $Li^{+}$, in order to produce the desired increase in conductivity of the material at about 1000° C. without undesired side effects. It is believed that for these compositions, the selected dopants act according to the mechanisms described above, but the exact mechanisms by which the dopants improve the overall performance of the materials are not fully understood and these theories are given for explanation only.

The dopant has an optimum effect within the range y=0.01–0.1. Values of y up to 0.2 or more, depending on the solubility limits of the specific dopant in the spinel lattice, can be tolerated without excessive contamination of the aluminium produced. Low dopant concentrations, y=0–0.005, are recommended only when the basic spinel structure is already somewhat conductive, i.e., when x=0.5–0.99, e.g., $Mn_{0.8}Fe_{0.2}Fe_2O_4$. Satisfactory results can also be achieved for low dopant concentrations, y=0.005–0.01, when there are two or more metals $M_I^{2+}$ providing a mixed ferrite, e.g., $Ni_{0.5}Zn_{0.5}Fe_2O_4$. It is also possible to combine two or more dopants $$M_{III}^{n+}O_{n/2}$$

within the stated concentrations.

The conductivity of the basic ferrites can also be increased significantly by adjustments to the stoichiometry by choice of the proper firing conditions during formation of the ceramic oxide material by sintering. For instance, adjustments to the stoichiometry of nickel ferrites through the introduction of excess oxygen under the proper firing conditions leads to the formation of $Ni^{3+}$ in the nickel ferrite, producing for instance $Ni_xNi_{1-x}Fe_2O_{4.5-x/2}$, y $$M_{III}^{n+}O_{n/2},$$

i.e., where $M_I = Ni^{2+}$, $M_{II} = Ni^{3+}$ and $Fe^{3+}$, $M_{III} = Al^{3+}$, $Cu^{2+}$, y=0–0.2, and preferably x=0.8–0.99.

Examples where the conductivity of the spinel is improved through the addition of excess metal cations are the materials $Ni_{1.2}Fe_2O_{4+}$, i.e., $NiFe_2O_4 + 0.2NiO$, where $M_I = M_{III} = Ni^{2+}$, y = 0.2 and $NiFe_{2.2}O_{4+}$, i.e., $NiFe_2O_4 + 0.2FeO_{3/2}$, where $M_{II} = M_{III} = Fe^{3+}$, y = 0.2.

The iron in both of the examples should be maintained wholly or predominantly in the $Fe^{3+}$ state to minimize the solubility of the ferrite spinel.

The distribution of the divalent $M_I$ and $M_{II}$ and trivalent $M_{II}$ into the tetrahedral and octahedral sites of the spinel lattice is governed by the energy stabilization and the size of the cations. $Ni_{2+}$ and $Co^{2+}$ have a definite site preference for octahedral coordination. On the other hand, the manganese cations in manganese ferrites are distributed in both tetrahedral and octahedral sites. This enhances the conductivity of manganese-containing ferrites and makes substituted manganese-containing ferrites such as $Ni_{0.8}Mn_{0.2}Fe_2O_4$ perform very well as anodes in molten salt electrolysis.

In addition to the preferred ferrites where $M_{II}$ is $Fe^{3+}$, other preferred ferrite-based materials are those where $M_{II}$ is predominantly $Fe^{3+}$ with up to 0.2 atoms of Ni, Co and/or Mn in the trivalent state, such as $Ni^{2+} \cdot Ni_{0.2}^{2+}Fe_{1.8}^{3+}O_4$.

More generally, satisfactory results are also obtained with other mixed ceramic spinels of the formula $$M_{I_x}^{2+}M_{II_{1-x}}^{2+}M_{II'_{1+z}}^{3+}M_{II''_{1-z}}^{3+}O_4$$

where $M_I$ and $M_{II}$ are the same as before, $M_{II'}$ and $M_{II''}$ are different metals from the $M_{II}$ group, and z=0–1.0. Good results may also be obtained with partially-substituted spinels such as $$Mn_{0.9}Co_{2.1}O_4$$

and non-stoichiometric spinels such as $$ZnMn_{2.2}O_{4.3}$$

which can be rewritten $$ZnMn_2O_4 + 0.1Mn_2O_3.$$

The anode preferably consists of a sintered self-sustaining body formed by sintering together powders of the respective oxides in the desired proportions, e.g, $$x\text{Mol } M_IO + (1 - x)\text{ Mol } Fe_3O_4 + x\text{Mol } Fe_2O_3 + y\text{Mol } M_{III}^{n+}O_{n/2}.$$

Sintering is usually carried out in air at 1150°–1400° C. The starting powders normally have a diameter of 0.01–20μ and sintering is carried out under a pressure of about 2 tons/cm$^2$ for 24–36 hours to provide a compact structure with an open porosity of less than 1%. If the starting powders are not in the correct molar proportions to form the basic spinel compound $$M_{Ix}M_{II3-x}O_4,$$

this compound will be formed with an excess of $M_IO$, $M_{II}O$ or $M_{II2}O_3$ in a separate phase. As stated above, an excess (i.e., more than 0.5 Mol) of $Fe^{2+}O$ in the spinel lattice is ruled out because of the consequential excessive iron contamination of the aluminium produced. However, small quantities of $M_IO$ and $M_{II2}O_3$ as separate phases in the material can be tolerated without greatly diminishing the performance, and the same is true for a small separate phase of FeO, providing there is not more than about 0.3 Mol of $Fe^{2+}O$ in the spinel lattice, i.e., when x=0.7 or more. In any event, not more than about 10% by weight of the anode body should consist of additional materials such as these ceramic oxides in a separate phase with the spinel of the stated formula. In other words, when dopants or a non-stoichiometric excess of the constituant metals in provided, these should be incorporated predominantly into the spinel lattice by solid solution, substitution or by the formation of interstitial compounds, but a small separate phase of the constituent oxides is also possible.

Generally speaking, the metals $M_I$, $M_{II}$ and $M_{III}$ and the values of x and y are selected in the given ranges so that the specific electronic conductivity of the materials at 1000° C. is increased to the order of about 1 ohm$^{-1}$cm$^{-1}$ at least, preferably at least 4 ohm$^{-1}$cm$^{-1}$ and advantageously 20 ohm$^{-1}$cm$^{-1}$ or more.

Laboratory tests with the anode materials according to the invention in conditions simulating commercial aluminium production have shown that these materials have an acceptable wear rate and contamination of the aluminium produced is generally <1500 ppm of iron and about 100 to about 1500 ppm of other metals, in the case of ferrite-based materials. This is a considerable improvement over the corresponding figures published by Belyaev, whereas it has been found that the non-doped spinel materials, e.g., ferrites of the formula $M_IFe_2O_4$(x=1), either (a) have such a poor conductivity that they cannot be effectively used as an anode, (b) are consumed so rapidly that no meaningful figure can be obtained for comparison, or (c) are subject to excessive meltline corrosion giving high contamination levels, this phenomenon presumably being related to the poor and irregular conductivity of the simple spinel and ferrite materials, so that these materials generally do not seem to give a reproducible result.

With anode materials according to the invention in which x=0.5–0.9, e.g, $Mn_{0.5}Zn_{0.25}Fe_{0.25}.Fe_2O_4$ and $Ni_{0.8}Fe_{0.2}Fe_2O_4$ it has been observed in laboratory tests simulating the described operating conditions that the anode surface wears at a rate corresponding to a surface erosion of 20–50 cm per year.

BRIEF DESCRIPTION OF THE DRAWING

The invention will be further illustrated with reference to the single FIGURE of the accompanying drawing which is a schematic cross-sectional view of an aluminium electrowinning cell incorporating substantially non-consumable anodes.

PREFERRED MODES OF CARRYING OUT THE INVENTION

The drawing shows an aluminium electrowinning cell comprising a carbon liner 1 in a heat-insulating shell 2, with a cathode current bar 3 embedded in the liner 1. Within the liner 1 is a bath 4 of molten cryolite containing alumina, held at a temperature of 940°–1000° C., and a pool 6 of molten aluminium, both surrounded by a crust or freeze 5 of the solidified bath. Anodes 7, consisting of bodies of sintered ceramic oxide material according to the invention with anode current feeders 8, dip into the molten alumina-cryolite bath 4 above the cathodic aluminium pool 6.

Advantageously, to minimize the gap between the anodes 7 and the cathode pool 6, the cathode may include hollow bodies of, for example, titanium diboride which protrude out of the pool 6, for example, as described in U.S. Pat. No. 4,071,420.

Also, when the material of the anode 7 has a conductivity close to that of the alumina-cryolite bath (i.e., about 2–3 ohm$^{-1}$cm$^{-1}$), it can be advantageous to enclose the outer surface of the anode in a protective sheath 9 (indicated in dotted lines) for example of densely sintered $Al_2O_3$, in order to reduce wear at the 3-phase boundary 10. Such an arrangement is described in U.S. Pat. No. 4,057,480. This protective arrangement can be dispensed with when the anode material has a conductivity at 1000° C. of about 10 ohm$^{-1}$cm$^{-1}$ or more.

The invention will be further described with reference to the following examples.

EXAMPLE I

Anode samples consisting of sintered ceramic oxide nickel ferrite materials with the composition and theoretical densities given in Table I were tested as anodes in an experiment simulating the conditions of aluminium electrowinning from molten cryolite-alumina (10% $Al_2O_3$) at 1000° C.

TABLE 1

| Sample Number | Composition | Theoretical Density | ACD (mA/cm$^2$) | Cell Voltage (V) | Corrosion Rate (micron/hr) |
|---|---|---|---|---|---|
| 1 | $NiFe_2O_4$ | 91.0 | 800 | 10.0–15.0 | −60 |
| 2 | $Ni^{2+}_{0.95}Fe^{2+}_{0.05}Fe_2O_4$ | 92.2 | 700 | 4.0–5.3 | −20 |
| 3 | $Ni^{2+}_{0.75}Fe^{2+}_{0.251}Fe_2O_4$ | 92.2 | 700 | 4.2 | −25 |
| 4 | $Ni^{2+}_{0.5}Fe^{2+}_{0.5}Fe_2O_4$ | 93.7 | 700 | 3.7–3.9 | −40 |
| 5 | $Ni^{2+}_{0.25}Fe^{2+}_{0.75}Fe_2O_4$ | 94.8 | 1000 | 3.5–3.7 | irregular (tapering) |

The different anode current densities (ACD) reflect different dimensions of the immersed parts of the various samples. Electrolysis was continued for 6 hours in all cases, except for Sample 1 which exhibited a high cell voltage and which passivated (ceased to operate) after only 2.5 hours. At the end of the experiment, the corrosion rate was measured by physical examination of the specimens.

It can be seen from Table I that the basic non-substituted nickel ferrite $NiFe_2O_4$ of Sample 1 has an insufficient conductivity, as evidenced by the high cell voltage, and an unacceptably high corrosion rate. However, the partly substituted ferrites according to the invention (x=0.95, Sample 2, to x=0.5, Sample 4) have an improved and sufficient conductivity as indicated by the lower cell voltages, and an acceptable wear rate. In particular, Sample 3, where x=0.75, had a stable, low cell voltage and a very low wear rate. For Sample 5 (x=0.25), although the material has good conductivity, it was not possible to quantify the wear rate due to excessive and irregular wear (tapering).

EXAMPLE II

The experimental procedure of Example I was repeated using sintered samples of doped nickel ferrite with the compositions shown in Table II.

TABLE II

| Sample Number | Composition | Theoretical Density | ACD ($mA/cm^2$) | Cell Voltage (V) | Corrosion Rate (micron/hr) |
|---|---|---|---|---|---|
| 6 | $NiFe_2O_4$ + 0.05 $TiO_2$ | 91.2 | 1000 | 4.2–6.0 | −50 |
| 7 | $NiFe_2O_4$ + 0.05 $SnO_2$ | 92.1 | 900 | 4.5–9.3 | −20 |
| 8 | $NiFe_2O_4$ + 0.05 $ZrO_2$ | 92.2 | 700 | 4.2–8.8 | slight swelling |
| 9 | $Ni^{2+}_{0.95}Fe^{2+}_{0.05}Fe_2O_4$ + 0.05 $ZrO_2$ | 90.3 | 800 | 4.5–5.5 | −10 |

As can be seen from the table, all of these samples had an improved conductivity and lower corrosion rate than the corresponding undoped Sample 1 of Example I. The partially-substituted and doped Sample 9 (x=0.95, y=0.05) had a particularly good dimensional stability at a low cell voltage.

EXAMPLE III

The experimental procedure of Example I was repeated with a sample of partially-substituted nickel ferrite of the formula $Ni_{0.8}Mn_{0.2}Fe_2O_4$. The cell voltage remained at 4.9–5.1 V and the measured corrosion rate was −20 micron/hour. Analysis of the aluminium produced revealed the following impurities: Fe 2000 ppm, Mn 200 ppm and Ni 100 ppm. The corresponding impurities found with manganese ferrite $MnFe_2O_4$ were Fe 29000 ppm and Mn 18000 in one instance. In another instance, the immersed part of the sample dissolved completely after 4.3 hours of electrolysis.

EXAMPLE IV

A partially-substituted nickel ferrite consisting of Fe 46 wt %, Ni 22 wt %, Mn 0.5 wt %, and Cu 3 wt %, was used as an anode in a cryolite bath contining aluminium oxide (5–10 wt %) maintained at about 1000° C. The electrolysis was conducted at an anode current density of 1000 $mA/cm^2$ with the current efficiency in the range of 86–90%. The anode had negligible corrosion and yielded primary grade aluminium with impurities from the anode at low levels. The impurities were Fe in the range 400–900 ppm and Ni in the range of 170–200 ppm. Other impurities from the anode were negligible.

Additional experiments using other partially-substituted ferrite compositions yield similar results as shown in Table III where ΣM/Fe represents the atomic ratio of the sum of the non-ferrous metals to iron. The relative solubility of Ni into cryolite is 0.02% and Table III shows that the contamination of the electrowon aluminium by nickel and iron from the substituted nickel ferrite anodes is small, with selective dissolution of the iron component. For instance, a sample having a Ni/Fe weight ratio of 0.48 gives a Ni/Fe weight ratio of about 0.3 in the electrowon aluminium.

TABLE III

| Sample Number | Composition by Wt % | ΣM/Fe | Aluminium Impurities ppm |
|---|---|---|---|
| 10 | Fe 46, Ni 22<br>Mn 0.5, Cu 3 | 0.523 | Ni 172,198,<br>Fe 484,856 |
| 11 | Fe 45.1<br>Ni 22.6<br>Al 1.3<br>Mn 0.6<br>Cu 2.7 | 0.60 | Ni <9.3,<br>Fe 1097 |
| 12* | Fe 45.5<br>Al 2.4<br>Co 0.85<br>Ni 25.2 | 0.65 | Ni <8.4,<br>Fe 1125 |
| 13 | Fe 46, Ni 8.5<br>Zn 17, Cu 3 | 0.55 | Ni 12.5,<br>Fe 417,<br>Zn 576 |
| 14 | Fe 47, Ni 8<br>Zn 17, Cu 3 | 0.53 | Ni 93,<br>Fe 1830,<br>Zn 860 |
| 15 | Fe 45, Ni 8.5<br>Zn 19 | 0.54 | Ni <8,<br>Fe 846,<br>Zn 829 |
| 16 | Fe 47, Ni 4<br>Zn 13, Mn 6<br>Cu 1.5 | 0.48 | Ni <9,<br>Fe 1375,<br>Zn 376,<br>Mn 409 |

*500 $mA/cm^2$, all others 1000.

What is claimed is:

1. In a process for the production of a metal by electrolysis of a metal compound dissolved in a molten salt electrolyte the improvement which comprises conducting said electrolysis using an anode comprising a body consisting essentially of a ceramic oxide material of spinel structure, characterized in that said material has the formula:

$$M_{Ix}\,M_{II3-x}\,O_4 \cdot y\,M^{n+}_{III}\,O_{n/2}$$

where:

$M_I$ is one or more divalent metals from the group Ni, Co, Mg, Mn, Cu and Zn;

x is 0.5–1.0;

$M_{II}$ is one or more divalent/trivalent metals from the group Ni, Co, Mn, and Fe, but excluding the case where $M_I$ and $M_{II}$ are both the same single metal;

$M_{III}^{n+}$ is one or more metals from the group $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{1+}$, where n is 1, 2, 3 or 4 depending upon the valence state of $M_{III}$; and the value of y is compatible with the solubility of $$M_{III}^{n+}O_{n/2}$$

in the spinel lattice and between 0 and 0.2, providing that, when y=0, then at least one of the following conditions is met:

(A) X is a value less than 0.99;

(B) there are at least two metals $M_I$;

(C) there are at least two metals $M_{II}$ which are not in equal whole atom proportions.

2. The process of claim 1, wherein $M_{II}$ is Fe.

3. The process of claim 2, where $M_{III}^{n+}$ is a metal from the group $Ti^{4+}$, $Zr^{4+}$, $Hf^{4+}$, $Al^{3+}$, $Co^{3+}$, $Cr^{3+}$ and $Li^{1+}$ and y=0–0.1.

4. The process of claim 2, wherein the anode body is a self-sustaining body sintered from a mixture of xMol $M_I^{2+}O$,(1−x) Mol $Fe_3O_4$, xMol $Fe_2O_3$ and $$yMol\ M_{III}^{n+}O_{n/2}.$$

5. The process of claim 1, wherein $M_{II}$ is predominantly Fe with up to 0.2 atoms of Ni, Co or Mn.

6. The process of claim 1, wherein the anode body is a sintered self-sustaining body containing up to 10% of other materials in a separate phase from the spinel material according to the given formula.

7. The process of claim 4 or 6, wherein the sintered anode body has an open porosity of less than 1%.

8. The process of claim 1 wherein each and every $M_{III}n+$ metal is the same as an $M_I$ metal and/or an $M_{II}$ metal.

9. The process of claim 1, 2, 3, 8 or 5, wherein x=0.8–0.99.

10. The process of claim 1, 2, 3, 8 or 5, wherein the spinel material contains at least two metals from the $M_I^{2+}$ group.

11. The process of claim 1, 2, 3, 8 or 5 wherein the spinel material contains at least two $M_{II}$ metals, which are not in equal whole atom proportions.

12. The process of claim 1, 2, 3, 8, 5, 4 or 6 wherein oxygen is evolved at the anode.

13. The process of claim 12, wherein the electrolyte is a cryolite-based fused bath containing alumina as the metal compound.

14. A substantially non-consumable anode for molten salt electrolysis comprising a body consisting essentially of a ceramic oxide material of spinel structure, characterized in that said material has the formula:

$$M_{Ix}M_{II3-x}O_4 \cdot y\,M_{III}^{n+}O_{n/2}$$

where:

$M_I$ is one more divalent metals from the group Ni, Co, Mg, Mn, Cu and Zn;

x is 0.5–1.0;

$M_{II}$ is one or more divalent/trivalent metals from the group Ni, Co, Mn and Fe, but excluding the case where $M_I$ and $M_{II}$ are both the same single metal;

$M_{III}^{n+}$ is one or more metals from the group $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{1+}$, where n is 1, 2, 3 or 4 depending upon the valence state of $M_{III}$; and the value of y is compatible with the solubility of $M_{III}^{n+}O_{n/2}$ in the spinel lattice and is between 0 and 0.2, providing that, when y=0, then at least one of the following conditions is met:

(A) X has a value less than 0.99;

(B) there are at least two metals $M_I$;

(C) there are at least two metals $M_{II}$ which are not in equal whole atom proportions.

15. The anode of claim 14, wherein $M_{II}$ is Fe and wherein the anode is used for the production of aluminum from a cryolite-based fused bath containing alumina.

16. The anode of claim 15, wherein the anode body is a self-sustaining body sintered from a mixture of xMol $M_I^{2+}O$,(1−x) Mol $Fe_3O_4$, xMol $Fe_2O_3$ and $$yMol\ M_{III}^{n+}O_{n/2}.$$

17. The anode of claim 14, wherein $M_{III}^{n+}$ is a metal from the group $Ti^{4+}$, $Zr^{4+}$, $Hf^{4+}$, $Al^{3+}$, $Co^{3+}$, $Cr^{3+}$ and $Li^{1+}$, and y=0–0.1.

18. The anode of claim 14, wherein $M_{II}$ is predominantly Fe with up to 0.2 atoms of Ni, Co or Mn.

19. The anode of claim 14, wherein the anode body is a sintered self-sustaining body containing up to 10% of other materials in a separate phase from the spinel material according to the given formula.

20. The anode of claim 16 or 19, wherein the sintered anode body has an open porosity of less than 1%.

21. A method of manufacturing the anode of claim 16 or 19, comprising mixing together powders of said oxides having particle sizes between about 0.01 and 20 microns and sintering the resulting mixture under pressure.

22. The anode of claim 14 wherein each and every $M_{III}^{n+}$ metal is the same as an $M_I$ metal and/or an $M_{II}$ metal.

23. The anode of claim 14, 15, 17, 22 or 18, wherein x=0.8–0.99.

24. The anode of claim 14, 15, 17, 22 or 19, wherein the spinel material contains at least two metals from the $M_I^{2+}$ group.

25. A cell for the electrolytic production of aluminum comprising a cryolite-based fused bath containing alumina into which dips an anode as claimed in any one of claims 14, 15, 17, 22, 18, 16 or 19.

26. The anode of claim 14, 15, 17, 22 or 18 wherein the spinel material contains at least two $M_{II}$ metals, which are not in equal whole atom proportions.

* * * * *